US010472985B2

(12) United States Patent
Khare et al.

(10) Patent No.: US 10,472,985 B2
(45) Date of Patent: Nov. 12, 2019

(54) ENGINE CASE FOR FAN BLADE OUT RETENTION

(71) Applicant: HONEYWELL INTERNATIONAL INC., Morris Plains, NJ (US)

(72) Inventors: Milind Khare, Karnataka (IN); Srinivas Chinthapally, Andhra Pradesh (IN); Avinash Kumar, Karnataka (IN); Venkatarao Ganji, Karnataka (IN); Theodore Brockett, Gilbert, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 305 days.

(21) Appl. No.: 15/375,536

(22) Filed: Dec. 12, 2016

(65) Prior Publication Data

US 2018/0163562 A1 Jun. 14, 2018

(51) Int. Cl.

| | |
|---|---|
| ***F01D 21/04*** | (2006.01) |
| ***F01D 25/24*** | (2006.01) |
| ***F01D 25/16*** | (2006.01) |
| ***F04D 29/056*** | (2006.01) |
| ***F04D 29/52*** | (2006.01) |
| ***F04D 19/00*** | (2006.01) |
| ***A47L 11/40*** | (2006.01) |

(52) U.S. Cl.

CPC ..... *F01D 21/045* (2013.01); *F01D 25/162* (2013.01); *F01D 25/24* (2013.01); *F04D 19/002* (2013.01); *F04D 29/056* (2013.01); *F04D 29/522* (2013.01); *A47L 11/4044* (2013.01); *A47L 11/4088* (2013.01); *F05D 2220/30* (2013.01)

(58) Field of Classification Search

CPC .. A47L 11/34; A47L 11/4044; A47L 11/4038; A47L 11/4088

See application file for complete search history.

(56) References Cited

U.S. PATENT DOCUMENTS

| | | | | |
|---|---|---|---|---|
| 4,534,698 A | | 8/1985 | Tomich | |
| 5,437,538 A | * | 8/1995 | Mitchell | F01D 21/045 415/200 |
| 5,439,348 A | | 8/1995 | Hughes et al. | |
| 5,516,257 A | * | 5/1996 | Kasprow | F01D 21/045 415/200 |

(Continued)

FOREIGN PATENT DOCUMENTS

| | | |
|---|---|---|
| EP | 2927432 A1 | 7/2015 |
| GB | 2442112 A | 3/2008 |

OTHER PUBLICATIONS

Extended EP Search Report for Application No. 17205043.7 dated Jun. 26, 2018.

*Primary Examiner* — Jacob M Amick
*Assistant Examiner* — Charles Brauch
(74) *Attorney, Agent, or Firm* — Lorenz & Kopf, LLP

(57) ABSTRACT

A turbine engine has an engine case with an inlet and an interior of the engine. A bearing is disposed on a portion of the engine case. A fan is disposed within the engine and rotates with operation of the engine. The fan includes a plurality of fan blades, and each fan blade is secured at a first end to a disk. A second end of each fan blade is disposed adjacent to the bearing. The portion is oriented relative to the fan such that a reaction force of a fan blade impacting the bearing is directed axially or away from the inlet.

19 Claims, 2 Drawing Sheets

(56) References Cited

U.S. PATENT DOCUMENTS

| | | | | |
|---|---|---|---|---|
| 6,149,380 | A * | 11/2000 | Kuzniar | F01D 21/045 415/173.4 |
| 6,575,694 | B1 | 6/2003 | Thompson et al. | |
| 6,913,436 | B2 | 7/2005 | McMillan et al. | |
| 2015/0118036 | A1 | 4/2015 | Ohtani et al. | |

* cited by examiner

ENGINE CASE FOR FAN BLADE OUT RETENTION

TECHNICAL FIELD

This patent generally relates to turbofan engines, and in particular, to a fan case for a turbofan engine having a structure to retain a fan blade or fan blade portion following a fan blade out event.

BACKGROUND

Turbofan engines operate with an high level of safety, reliability and efficiency, which is a credit to the engine designer who is challenged to design an engine to operate under numerous conditions and to address any contingency. One such contingency event is known as a fan blade out event.

The fan is a vital component of a turbofan engine such as those that are commonly found on aircraft. The fan will have fan blades that extend radially outwardly from a central hub or disk. Fan designs differ primarily in the manner in which the blades are structurally tied or connected to the disk. In one fan design type, a dovetail connection is used to connect the fan blade and an associated shank to the disk. In another fan design type, the fan blade airfoil itself, without a shank, is welded to the disk. This later design is sometimes referred to as a bladed disk (or BLISK) fan, as the blades and disk form an integrated unit.

The fans operate at high rotational speed, and the fan blades themselves experience significant operating stresses, particularly in a radial direction extending away from the disk. In the fan blade out event, the fan blade or a portion of the fan blade separates from the disk and is discharged into the engine case. The design challenge is to ensure that fan blade fragments and other detritus are contained by the engine case during a fan blade out event.

In a typical fan blade out event, the fan blade separates at a minimum cross-sectional thickness region adjacent the disk. The result is the release of the fan blade airfoil part and the shank part, if a dovetail design, from the disk. The released fan blade interacts with at least the first trailing blade and the surrounding engine case.

In the case of a dovetail design, because of the presence of the platform and shank, the released blade interacts with the first trailing blade and the containment case simultaneously. Because of the blade profiles, the first trailing blade tends to draw the released blade aft-wards, i.e., into the engine axially. Whereas the impact force on the released blade due to its interaction with the containment case tries to push the released blade forward due to the conical shape of the containment case. In a dovetail because of the significant interaction of the released blade with first trailing blade, the released blade tends to move in a direction into the engine.

In aircraft engines with a BLISK type fan blade design, the fan blades are frictionally welded to the disk at the root. Hence there is no shank present at the root of the fan blade as would be found in a dovetail type fan blade design. In a fan blade out event in an engine with a BLISK fan blade design, it is more likely an airfoil part of the blade will separate from the disk than for the disk itself to separate or disintegrate. It has been observed that as much as 80% or more of the full blade airfoil may separate in a fan blade out event of a BLISK fan.

The separated airfoil portion of a BLISK fan blade, even as much as the entire fan blade, has less mass and therefore less inertia than a dovetail design fan blade, which includes the shank and attaching platform. Moreover, the absence of a shank and attaching platform from the BLISK fan blade moves the center-of-gravity (CG) of the released airfoil portion radially outwardly from the disk. A result of these differences is that in a fan blade out event in a BLISK fan engine, the released blade part to first trailing blade interaction occurs much later after blade release. By the time of interaction with the first trailing blade, which tends to draw the released blade into the engine, the desired direction, as much as or more than 50% of the released blade part will have engaged the engine case. Engagement of the blade part with the engine case tends to move the blade part toward the engine inlet and potentially out of the engine case.

Therefore, it is desirable to provide an engine case design for turbofan engines that has the effect of retaining fan blade parts within the engine case in a fan blade out event. This may be accomplished by an engine case design that tends to direct fan blade parts into the engine after a blade out event. Other desirable features and characteristics of the herein described embodiments will become apparent from the subsequent detailed description and the appended claims, taken in conjunction with the accompanying drawings and the foregoing technical field and background.

SUMMARY

A turbofan engine has an engine case with an inlet and an interior. A bearing is disposed on a portion of the engine case. A fan is disposed within the engine and rotates with operation of the engine. The fan includes a plurality of fan blades, and each fan blade is secured at a first end to a disk. A second end of each fan blade is disposed adjacent to the bearing. The engine case portion is oriented relative to the fan such that a reaction force of a fan blade impacting the bearing is directed axially or away from the inlet until a first trailing blade interacts with the fan blade.

A case for a turbofan engine includes a case structure and bearing configured and cooperate to effect a primary load bearing member such that the engagement of a fan blade or portion thereof following a fan blade out with the first trailing blade becomes significant.

A method of containing a fan blade or portion thereof and collateral structures that may be released in a fan blade out event may include retarding a radial outward movement of the released blade portion after the blade out event until there is an interaction of the released blade portion with a first trailing blade.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

Embodiments of the subject matter described herein provide an engine case design for turbofan engines that has the effect of retaining fan blade parts within the engine case in a fan blade out event by directing fan blade parts into the engine after a blade out event.

Figure 1:
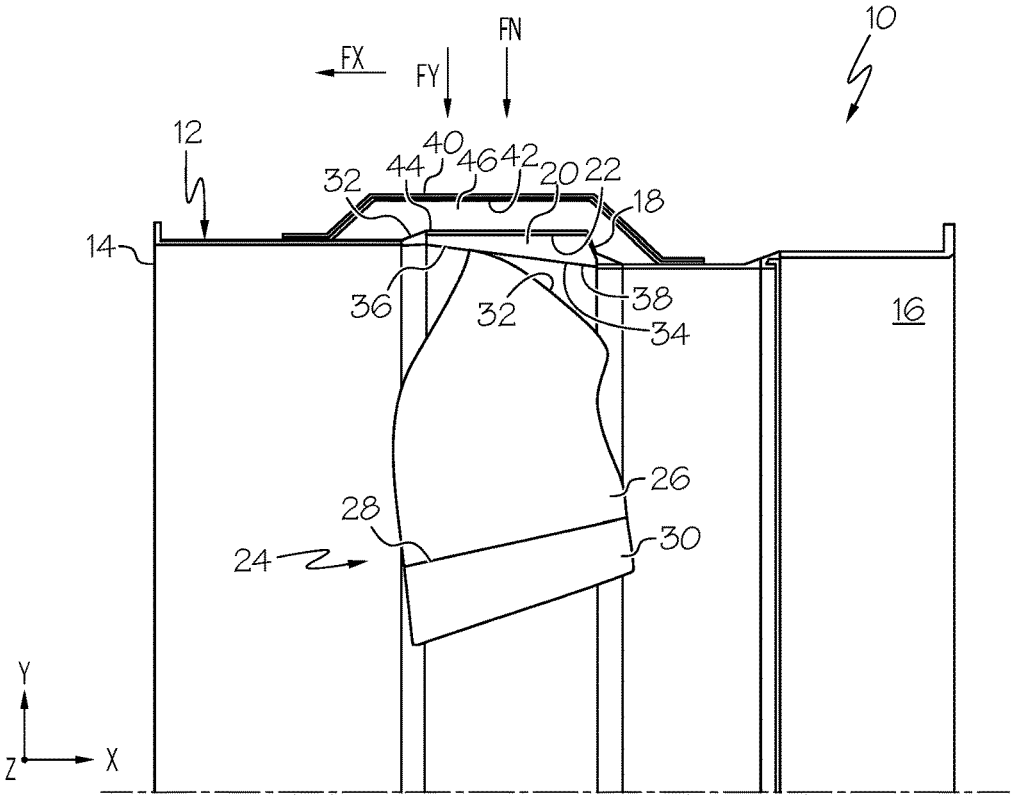
FIG. 1 is a graphic cross-sectional illustration of an inlet portion of a turbine engine in accordance with herein described exemplary embodiments.
Figure 2:
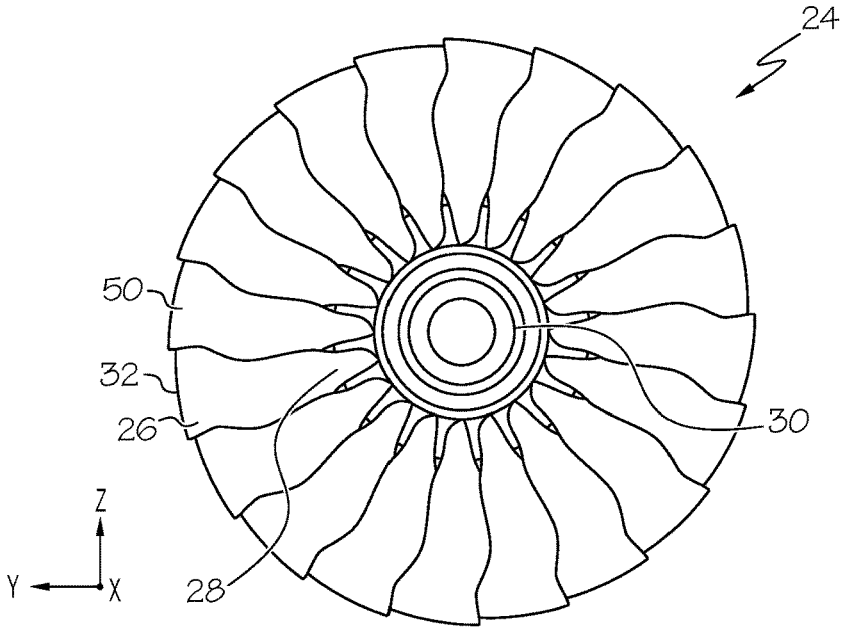
FIG. 2 is a graphic depiction of a blade disk (BLISK) fan.

Referring to FIGS. 1 and 2, a turbine engine 10 includes an engine case 12 with an inlet 14 and an interior 16. A bearing 20 is disposed on a case portion 18 of the engine case 12. A fan 24 is disposed within the engine case 12 and rotates with operation of the engine 10 in a known manner. The fan 24 includes a plurality of fan blades (one illustrated as fan blade 26), and each fan blade 26 is secured at a first end 28 to a disk 30. A second end 32 of each fan blade is disposed closely adjacent to a surface 34 of the bearing 20. The case portion 18 includes surface 22 that is oriented relative to the fan 24 such that a reaction force of the fan blade 26 or a portion of the fan blade 26 impacting the bearing 20 during a fan blade out event is directed radially inward toward a centerline "c/l" of the engine 10. Because there is less axial force coming from the interaction with case onto the blade, the axial motion of the blade is relatively away from the inlet 14 and toward the interior 16.

In an exemplary embodiment, the bearing 20 has a non-uniform thickness or cross-section from the inlet 14 to the interior 16. As depicted in FIG. 1, the bearing 20 tapers from a first edge 36 adjacent the inlet 14 to a second edge 38 toward the interior 16. The case portion 18 is made cylindrical. That is, the surface 22 of the portion 18 of the case 12 is substantially parallel to the engine centerline, c/l, and in this regard, the surface 22 of the case portion 18 forms a right, circular cylinder. The bearing 20 by virtue of the taper provides a narrowing of the engine inlet 14 toward the interior 16 of the engine 10.

With continued reference to FIG. 1, in a fan blade out event, the fan blade 26 or a fan blade portion (not depicted) separates from the disk 30 at or near the first end 28. Upon release, the fan blade 26 will move radially outwardly from the centerline c/l and encounters the bearing 20, which is supported by the case portion 18 along the surface 22. A force, FN, is imparted on the fan blade 26. Because the surface 22 of the case portion 18 is parallel to the centerline c/l, the force FN is primarily directed radially inward back toward the centerline c/l (e.g., $F_y$), with little or no axial component (e.g., $F_x$). In particular, the surface 22 is oriented such that the force FN is radially directed toward the centerline with no significant axial component being directed toward the inlet 14. This reduced the likelihood that the fan blade 26 will move toward the inlet 14 and outward of the engine case 12.

Still referring to FIG. 1, surrounding the case portion 18 is a containment member 40 and disposed between an inner surface 42 of the containment member 40 and an outer surface 44 of the engine case 12 in the area of portion 18 is an energy absorbing material 46. The energy absorbing material may be a polymeric honeycomb, or metallic honeycomb, and the containment member 40 may likewise be made of Kevlar fiber or may be made of carbon fiber. Alternatively, the containment member may be made of aluminum, aluminum alloys or other metallic or polymeric materials and combinations thereof. The energy absorbing material material 46 and containment member 40 cooperate to supplement the engine case 12 to contain the fan blade 26 during a fan blade out event. However, by design, the energy absorbing material 46 deflects and compresses in order to absorb and dissipate energy. On its own, therefore, the engine case 12, energy absorbing material 46 and containment member 40 only partially restrict radial outward movement of the fan blade 26 during a blade out event. To retard, e.g., delay and/or limit, at least at the initial moment of the fan blade out event, radial outward movement of the fan blade 26, the bearing 20 is made of an abradable but stiff material, such as aluminum, aluminum alloys, other metallic alloys or equivalent materials. It is only necessary to briefly retard the radial outward movement of the fan blade 26 following a fan blade out event until the first following blade 50 (see, FIG. 2) of the fan 24 interacts with the fan blade 26. The configuration of the fan blades 26 is such that the interaction of the fan blade 26 and the first following fan blade tends to cause an axial movement of the fan blade 26 toward the interior 16 of the engine 10. Thus, it is evident that the structure of the bearing 20 and the case portion 18 cooperate to provide a primary interaction of the fan blade 26 with the first following fan blade after a fan blade out event, and to further limit movement of the fan blade 26 or fan blade portion toward the inlet 14.

Figure 3:
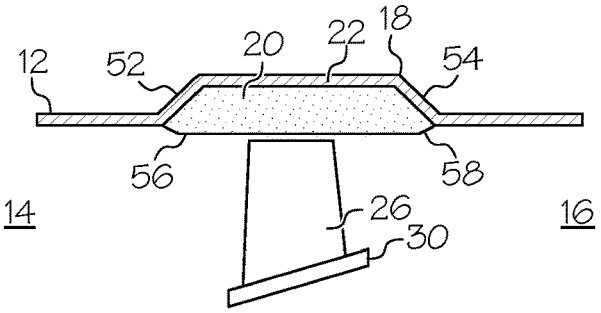
FIG. 3 is a graphic cross-sectional illustration of an inlet portion of a turbine engine in accordance with an alternate exemplary embodiment.

Referring to FIG. 3, the case portion 18 includes a leading and trailing chamfer 52 and 54 extending between the surface 22. The surface 22 is still arranged parallel to the centerline c/l. The bearing 20 has an pseudo-hexagonal cross-section that is thinner toward a first edge 56 adjacent the inlet 14 and thicker at a second edge 58 adjacent the interior 16. In accordance with this alternative embodiment, the bearing 20 and the case portion 18 cooperate to provide a primary interaction of the fan blade 26 with the first following fan blade 50 after a fan blade out event, and to further limit movement of the fan blade 26 or fan blade portion toward the inlet 14.

Figure 4:
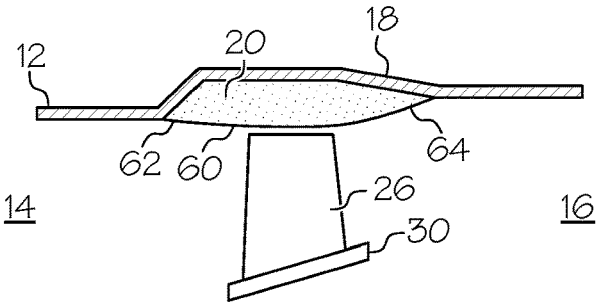
FIG. 4 is a graphic cross-sectional illustration of an inlet portion of a turbine engine in accordance with an alternate exemplary embodiment.

Referring to FIG. 4, the case portion 18 is formed with a hemispherical surface 60. The bearing 20 is ovoid, and the ovoid is thinner toward a first edge 62 adjacent the inlet 14 and thicker at a second edge 64 adjacent the interior 16. In accordance with this alternative embodiment, the bearing 20 and the case portion 18 cooperate to provide a primary interaction of the fan blade 26 with the first following fan blade 50 after a fan blade out event, and to further limit movement of the fan blade 26 or fan blade portion toward the inlet 14.

Figure 5:
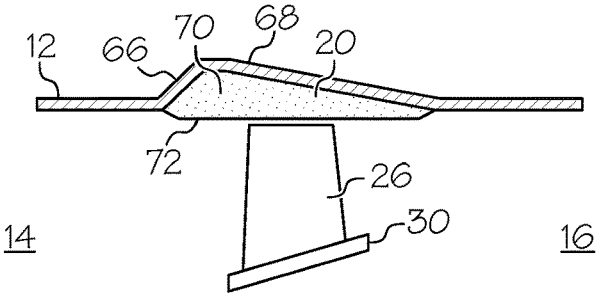
FIG. 5 is a graphic cross-sectional illustration of an inlet portion of a turbine engine in accordance with an alternate exemplary embodiment.

Referring to FIG. 5, the case portion 18 is formed with a first angled surface 66 and a second angled surface 68. The bearing 20 has a triangular cross-section 70 that fills the cross-section defined by the surfaces 66 and 68, and has a surface 72 parallel to the centerline c/l. In accordance with this alternative embodiment, the bearing 20 and the case portion 18 cooperate to provide a primary interaction of the fan blade 26 with the first following fan blade 50 after a fan blade out event, and to further limit movement of the fan blade 26 or fan blade portion toward the inlet 14.

In accordance with the herein described embodiments, a turbofan engine includes an engine case with an engine case structure and a bearing to ensure that a fan blade or portion thereof and collateral structures that may be released in a fan blade out event are retained within the engine case. In one exemplary embodiment, the radial movement of the released portion of a fan blade is retarded, e.g., delayed or limited, sufficiently to cause it to engage and interact primarily with a first trailing blade. Because of the profile of the fan blades, the interaction of the released blade portion with the first trailing blade tends to direct the released blade portion axially inward relative to an inlet of the turbine engine and into the engine case. The released blade portion is thereby first directed into the engine case before the inertia of the released blade portion causes it to travel radially outward and engage the containment case and a containment structure. The net effect is that axial outward motion, relative to the inlet of the turbine engine is reduced.

To achieve this result, the case structure and bearing are configured and cooperate to effectively change the primary load bearing member, i.e., the primary resistance to the movement of a fan blade or portions thereof following a fan blade out event, such that first primary engagement of the fan blade or portion thereof following a fan blade out event is with the first trailing fan blade. The bearing is abradable and may be made of aluminum, aluminum alloys, other metallic alloys or equivalent materials. The bearing may have a non uniform cross-section, and in at least one of the herein described embodiments, tapers from a thicker section toward the engine interior to a thinner section adjacent engine inlet. The bearing further may be made to be stiffer than surrounding, energy absorbing containment structures to retard axial movement of the released fan blade or released fan blade portion. This ensures that the interaction of the released fan blade or fan blade portion with the first trailing fan blade begins early and lasts longer, thereby effectively reducing motion of the released fan blade or fan blade portion toward the engine inlet.

A method of containing a fan blade or portion thereof and collateral structures that may be released in a fan blade out event may include retarding, e.g., reducing and/or delaying, a radial outward movement of the release blade portion after the blade out event until there is an interaction of the released blade portion with a first trailing blade. The reducing/delaying of the radial outward movement of the released blade portion may be accomplished by providing a bearing within the engine case adjacent tips of the fan blades. Providing the bearing may further include retaining the bearing by the engine case or by a retaining portion of the engine case. The retaining portion of the engine case may be made by providing a cylindrical structure within the engine case and engaging the bearing at least in a radial direction relative to a centerline of an engine.

The foregoing detailed description is merely exemplary in nature and is not intended to limit the application and uses. Furthermore, there is no intention to be bound by any expressed or implied theory presented in the preceding technical field, background, brief summary or the detailed description. It should be understood that throughout the drawings, corresponding reference numerals indicate like or corresponding parts and features. As used herein, the term system or module may refer to any combination or collection of mechanical systems and components and/or other suitable components that provide the described functionality.

Embodiments may be described herein in terms of functional and/or logical block components and various processing steps. It should be appreciated that such block components may be realized by any number, combination or collection of mechanical components configured to perform the specified functions. Those skilled in the art will appreciate that the herein described embodiments may be practiced in conjunction with any number of mechanical components and systems, and that the systems described herein are merely exemplary.

For the sake of brevity, conventional components and techniques and other functional aspects of the components and systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the invention.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof. Accordingly, details of the exemplary embodiments or other limitations described above should not be read into the claims absent a clear intention to the contrary.

What is claimed is:

1. A turbofan engine comprising:

an engine case with an inlet and an interior of the engine;

a bearing disposed on a portion of the engine case;

a fan is disposed within the interior and rotates with operation of the engine, the fan having a plurality of fan blades, each fan blade is secured at a first end to a disk, and a second end of each fan blade is disposed adjacent to the bearing, wherein the bearing is disposed between the engine case and the interior, the bearing including an abradable portion of non-uniform cross-section adjacent the second ends of the fan blades and a bearing case disposed between the engine case and the abradable portion that has a bearing case surface disposed between the engine case and the abradable portion and that is oriented relative to a centerline of the engine so that a force on a fan blade impacting the bearing case surface directs the fan blade axially inward or away from the inlet and into a first trailing blade.

2. The turbofan engine of claim 1, further comprising an energy absorbing structure disposed between the engine case and the bearing case.

3. The turbofan engine of claim 2, the bearing having a non-uniform thickness or cross-section that is narrower at a leading edge and thicker at a trailing edge.

4. The turbofan engine of claim 1, the abradable portion being hemispherical.

5. The turbofan engine of claim 1, the abradable portion being ovoid.

6. The turbofan engine of claim 1, the abradable portion including a first angled surface and a second angled surface.

7. The turbofan engine of claim 6, wherein the bearing case surface is parallel to the centerline of the engine.

8. The turbofan engine of claim 1, wherein the abradable portion has a non-uniform thickness or cross-section from the inlet to the interior.

9. The turbofan engine of claim 1, further comprising a containment structure surrounding the bearing case.

10. The turbofan engine of claim 9, wherein the containment structure comprises an energy absorbing member enclosed by a strengthening member.

11. An engine case for a turbofan engine comprising:

a case structure; and a bearing, wherein the case structure and the bearing are cooperatively arranged to effect a primary load bearing member such that primary fan blade out engagement of a fan blade or portion thereof is with a first trailing fan blade by the bearing being disposed between an outer portion of the engine case and an interior of the engine defined by the engine case, the bearing including an abradable portion of non-uniform cross-section and a bearing case disposed between the engine case and the abradable portion that has a bearing case surface disposed between the outer portion and the abradable portion that is oriented relative to a centerline of the engine so that a force on a fan blade impacting the bearing case surface directs the fan blade axially inward and into the first trailing blade.

12. The engine case of claim 11, where the case structure and bearing further cooperate to retard a radially outward movement of the fan blade or fan blade portion following a fan blade out event.

13. The engine case of claim 12, wherein the bearing has a non-uniform cross-section from an inlet of the engine case to the interior of the engine the bearing having a non-uniform thickness or cross-section that is narrower at a leading edge and thicker at a trailing edge.

14. The engine case of claim 11, wherein the bearing case surface is oriented parallel to a centerline of the engine.

15. The engine case of claim 11, wherein the bearing is hemispherical.

16. The engine case of claim 11, wherein the bearing is ovoid.

17. The engine case of claim 14, the bearing case surface including a first angled surface and a second angled surface.

18. The engine case of claim 17, the bearing case having a bearing case surface that is substantially parallel to a centerline of the engine.

19. The engine case of claim 11, further comprising a containment structure disposed between the outer portion and the bearing case and surrounding the bearing case in a region of the abradable portion.

* * * * *